United States Patent [19]

Givler

[11] Patent Number: 4,710,743

[45] Date of Patent: Dec. 1, 1987

[54] THERMOSTATIC DEVICE WITH LEAK TIGHT CASING

[75] Inventor: Omar R. Givler, North Canton, Ohio

[73] Assignee: Portage Electric Products, Inc., North Canton, Ohio

[21] Appl. No.: 942,621

[22] Filed: Dec. 16, 1986

Related U.S. Application Data

[63] Continuation-in-part of Ser. No. 804,492, Dec. 4, 1985, abandoned.

[51] Int. Cl.[4] ..... H01H 37/04; H01H 37/52

[52] U.S. Cl. ..... 337/380; 337/112

[58] Field of Search ..... 337/380, 372, 89, 94, 337/112, 347, 349

[56] References Cited

U.S. PATENT DOCUMENTS 3,100,827 8/1963 Grimshaw ..... 337/380

*Primary Examiner*—Harold Broome

*Attorney, Agent, or Firm*—McAulay, Fields, Fisher, Goldstein & Nissen

[57] ABSTRACT

A thermostatic device is provided which is formed from a cup, into which a bimetallic element is placed, and a generally flat lid which is crimped to the cup-shaped member, a layer of insulation being placed between the cup and lid. At least the ends of the lid are slightly formed to increase the pressure in these areas after crimping, so as to prevent leakage, particularly leakage of insulating materials, into the interior of the thermostatic device.

4 Claims, 6 Drawing Figures

THERMOSTATIC DEVICE WITH LEAK TIGHT CASING

CROSS-REFERENCE TO RELATED APPLICATIONS

This application is a continuation-in-part of prior copending application Ser. No. 804,492, filed Dec. 4, 1985, now abandoned, by Omar R. Givler, and assigned to the same assignee as the present invention, for "THERMOSTATIC DEVICE WITH LEAK TIGHT CASING."

BACKGROUND OF THE INVENTION

Thermostatic devices have previously been disclosed, the lower portion of which is in the form of a drawn or pressed cup. This cup may be electrically conducting or may be insulating, depending upon the construction. A bimetallic element is attached to some portion of this cup to provide the operating mechanism of the thermostatic device. The opening in the cup is then closed by attaching a lid of some type. Again, the lid may be electrically conducting or insulating.

Particularly when the cup and lid are formed of electrically conducting materials, prior to final assembly of the device, a sheet of insulating material is generally placed over a ledge which is formed ont he cup member, the lid is then placed above this, and the side edges of the cup are then rolled over so as to crimp the lid and insulating member in position. Structures of this type are shown, for example, in U.S. Pat. No. 3,100,827, Grimshaw; U.S. Pat. No. 3,430,177, Audette; and U.S. Pat. No. 4,521,760, Carbone et al.

As illustrated in the referenced patents, it is generally the sides of the cup-shaped members which are rolled over in order to crimp the lid and the insulating sheet to the cup shaped member, and no crimp is provided at the ends of the device. Frequently, the thermostatic device is employed in a motor winding which is varnish impregnated after completion of winding. When the thermostatic device as just described is employed, because of the lack of crimping at the ends, the varnish, prior to drying, frequently leaks into the thermostatic device through the ends and may either disable the device, entirely, or, at least, distort its planned operation.

Since the crimping of a lower cup shaped member to an upper lid, with the intermediate insulating member, is such a desirable method of operation, particularly for reasons of economy, means have been sought to prevent the leakage of insulating materials into thermostatic devices formed in this way, but without particular success. For example, the insulating sheet which is placed between the cup and the lid is frequently impregnated with a B stage resin which cures upon heating of the device. Similarly, attempts have been made to seal the ends of the device with Glyptal, an alkyd-type polymer of the General Electric Company, and other similar polymers. The B stage resin impregnated insulators are ineffective, and, while the Glyptal seal prevents insulation material from leaking through, the Glyptal, itself, leaks through to create the same problems as the insulating varnish.

BRIEF DESCRIPTION OF THE INVENTION

In accordance with the present invention, a thermostatic device is constructed, in general, in accordance with the teachings of the prior art. By that, it is meant that a cup-shaped member of the casing is formed by drawing or pressing and, to this cup-shaped member, an operating bimetal is attached. An insulating member is then inserted above the cup, the insulating member resting, generally, on a ledge formed on the cup-shaped member. A lid is placed on the insulating member, the lid having a stationary contact attached to its inner surface. After assembly, upstanding wings on the cup-shaped member are folded over so as to crimp the lid in place, the insualting member being held between the cup-shaped member and the lid.

In accordance with the present invention, however, the lid is not totally flat. At least the ends of the lid, which are not directly involved in the crimping operation, are drawn to provide a slight form or stepped-down area. If desired, the entire lid may be drawn to provide the same effect, or some portion of the lid may be drawn to provide the formed area, leaving the remainder flat, so long as the ends of the lid are slightly formed. In either event, the central portion of the form area, prior to bending over of the wings to accomplish the crimping, rests against the insulating member and ledge. When the sides of the lid are crimped in place, the formed area in the lid exerts pressure at the outer edges, the result being the application of pressure all along the length of the formed area. This tends to create pressure between the ends of the lid and the portions of the cup-shaped member which are adjacent the ends of the lid, the insulating member lying between the two. Because of this pressure, liquid materials, such as the varnish applied to motor windings, is generally prevented from leaking into the operational portion of the thermostatic device, thus allowing for proper operation of that device. Because the central portion, or center, of the formed area is against the insulating member and the ledge, as the pressure is first applied to the outer edges of the formed area which are not then in contact with the insulating member and ledge, but are forced into contact with them while the central portion remains in contact, pressure is exerted all along the insulating member and ledge to provide the desired effect.

DESCRIPTION OF THE PREFERRED EMBODIMENTS

Figure 1:
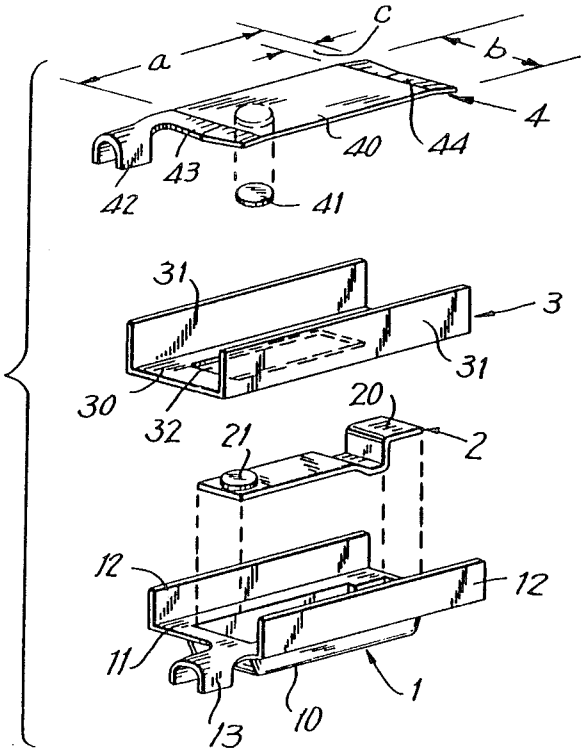
FIG. 1 is an exploded view, in perspective, of a thermostatic device in accordance with the present invention showing each of the parts.

Referring to the accompanying drawings, FIG. 1 illustrates, in exploded perspective, the components of the thermostatic device in accordance with the present invention including a lower cup-shaped member 1, a bimetallic element 2, a sheet of insulating material 3, and an upper lid 4.

The lower cup-shaped member includes the cup 10, a ledge 11 which extends all around the opening of the cup 10, and two upstanding wings 12. Formed as a part of the ledge, at one end, is a terminal 13, to which a lead can be crimped.

The bimetal arm 2 is attached, at the end 20, to the cup-shaped member 1. The specific point of attachment is immaterial, and the bimetal 2 can be attached to the bottom of the drawn or pressed cup, can be attached to the ledge 11. To the end opposite the end 20 of attachment, a movable contact 21 is attached to the bimetal. Attachment is by means well known in the art.

The insulating member 3 can be formed of any of the mineral or fabric insulators which are well known in the art. Additionally, it can be formed of a paper material, such as cardboard. If desired, as has previously been practiced in the art, the material from which the insulating member 3 is made can be impregnated with a resin, such as a B stage resin, which is later cured, after assembly of the thermostatic device. The insulating member 3 is provided with a base portion 30 which, on assembly, rests against the ledge 11, and upstanding wings 31, which lie within the upstanding wings 12 of the base portion 1. Additionally, the insulating member 3 is provided with a cut-out 32 through which the bimetal member 2 can move in order to have the movable contact 21 mate with the stationary contact.

The members just described are in accordance with similar pieces employed in the prior art. The improvements of the present invention are found in the lid 4, to be described below.

Figure 2:
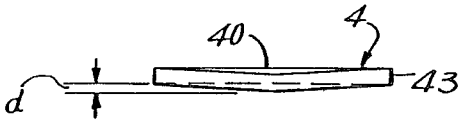
FIG. 2 is an end view of the lid of the thermostatic device, prior to assembly.

As employed in the present invention, the lid 4 is formed of a conductive material and preferably includes a central, generally flat surface 40. Attached to the lower portion of the lid, so that it faces inwardly on assembly of the thermostatic device, is a button 41 of conductive material which forms the stationary contact of the thermostatic device. Extending from one end of the lid 4 is a terminal member 42 into which a lead may be crimped. The portions of the lid at the ends 43 and 44 are drawn to form a stepped-down configuration as best seen in FIG. 2. The purpose of the stepped-down formed area is to create additional pressure at the center of the ends, where a crimp is not effected, so as to provide a tighter seal between the lid 4, the insulating member 3, and the cup-shaped, base member 1 after assembly and crimping of the device. In this way, the assembled theremostatic device of the present invention is more leak tight than similar devices employed in the prior art. As pressure is applied to the portions of the stepped-down formed area remote from the center, inherently, the center is first pressed against the insulating member and ledge, and the portions remote from the center are then forced down, so that a uniform, leak tight assembly is formed.

Figure 3:
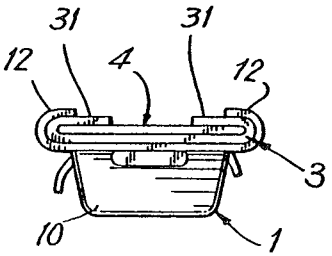
FIG. 3 is an end view of the fully assembled device of FIG. 1.
Figure 4:
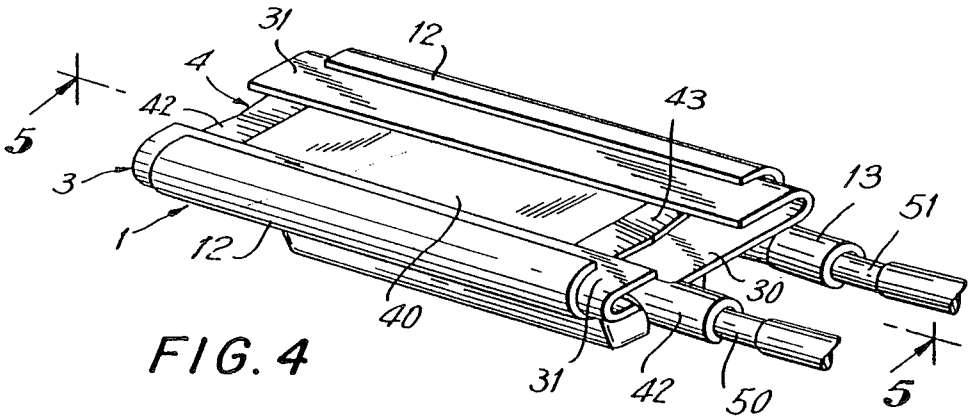
FIG. 4 is a perspective view of the fully assembled thermostatic device in accordance with the present invention.
Figure 5:
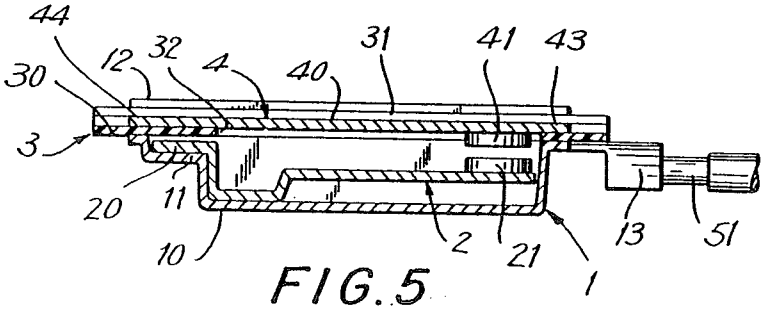
FIG. 5 is a view along the line 5—5 of FIG. 4.

The device, in its assembled form, is best illustrated in FIGS. 3, 4, and 5 which show the base or cup-shaped member 1 having the insulating member 3 lying on the ledge, and topped with the lid 4, the three being held together by folding over of the wing members 12 of the cup-shaped member 1 in order to crimp the lid 4 and insulating member 3 to the cup-shaped member 1. FIGS. 4 and 5 illustrate leads 50 and 51 crimped within terminals 13 and 42. The bimetal member 2 is illustrated as mounted within cup-shaped member 1.

Figure 6:
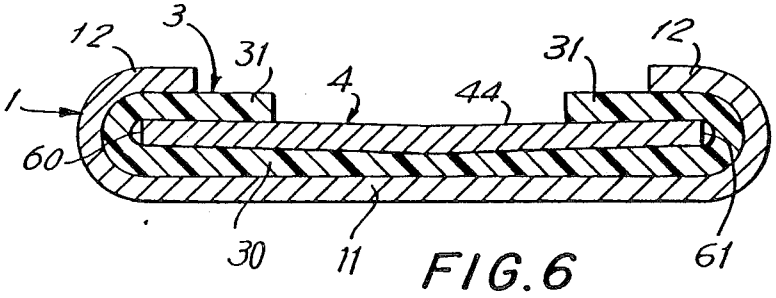
FIG. 6 is a magnified view of the thermostatic device of the present invention, showing the form of the end of the lid after crimping.

As best illustrated in FIG. 6, even after crimping, the formed area at the ends of lid 4 is not completely flattened. FIG. 6 is, in effect, a magnified view of a portion of FIG. 3 showing the insulating member 3 and the end 44 of lid 4 in place after crimping. It will be seen that the edges 60 and 61 of end 44 are still slightly raised from the flat portion of the insulating member 3. This aids in maintaining the additional pressure on the insulating member and, hence, on the end of ledge 11 of bottom 1. It is obvious that this pressure is applied because of the spring force generated by the ends of the lid when crimping is applied to the edges, Inherently, the pressure is first applied to the center of the end 44, as the edges 60 and 61 are bent down in the crimping operation. It will also be noted that the insulating member 3 lies generally flat against ledge 11.

As best seen in FIGS. 1 and 3, the lid is preferably formed only at the ends. In the device illustrated in the figures, the length of the lid, as represented by the dimension a is approximately 0.72 inch and the width, represented by dimension b, is approximately 0.3 inch. Under these circumstances, the width of the formed section, as represented by the dimension c, is approximately 0.045 inch. With the dimensions just described, the height of the formed portion, as best illustrated by the dimension labeled d in FIG. 2, is approximately 0.008 inch. Obviously, both the width and the depth of the formed section can be varied, not only in accordance with the size of the parts being employed, but as desired depending upon the effect to be achieved. The dimensions given are merely illustrative of workable dimensions.

The drawing of the lid so as to provide a formed section only at the ends of the lid, as described above, is the preferred embodiment. It will be appreciated, however, that, if desired, the entire lid can be drawn to give the same effects. Further, if desired, while not drawing the entire lid, the drawn portion can extend further toward the center from either or both ends than is illustrated. In any event, the central portion of the end is first forced down, as the edges are crimped toward the insulating member and ledge.

Employing thermostatic devices manufactured in accordance with the present invention, the thermostatic device can be placed in the winding of an electrical motor or other device prior to application of the insulating varnish. The presence of the form at the ends of the lid portion of the thermostatic device provides sufficient pressure after crimping of the lid and insulating material to the base, or cup portion, of the thermostat that liquid tightness is achieved, even at the ends of the thermostatic device casing. This pressure is sufficient to prevent the entry of the insulating varnish into the casing of the thermostatic device when the motor windings are insulated.

While specific embodiments of the invention have been shown and described, it should not be considered as thus limited, but only as limited by the appended claims.

I claim:

1. In a thermostatic device having a cup-shaped base, said base being provided with a ledge around the opening of the cup in said cup-shaped base; and insulating member adapted to lie against the ledge provided on said base; and a lid to lie above the insulating member; means being provided on said ledge for crimping said base, said insulating member, and said lid together, said lid being crimped to said ledge of said base, through said insulating member, by action of said means on said ledge for crimping said base, said insulating member, and said lid together; the improvement which comprises a stepped-down area in said lid, only the center of said stepped-down area lying against said insulating member prior to crimping said base, said insulating member, and said lid together.

2. The thermostatic device of claim 1 wherein the stepped-down area is formed at each end of said lid.

3. A thermostatic device comprising:

a. a base having a depressed portion formed therein, a ledge surrounding said depressed portion, and wings attached to two opposite sides of said ledge;

b. a bimetallic element placed within said depressed portion, one end of said bimetallic member being provided with a movable contact adapted to move upward toward a stationary contact upon bending of said bimetallic element;

c. an insulating member having a first section adapted to be supported by said ledge of said base and two upstanding wings, formed on opposite sides of said first section, and adapted to lie within said two wings of said base, the center of said insulating member being provided with an opening to allow movement of said bimetallic element; and d. a lid member adapted to rest against said first section of said insulating member, said lid being crimped against said ledge of said base, through said insulating member, by action of the two wings of said base, said base and said lid member being separated by said insulating member, said lid member having a stepped-down area therein, said stepped-down area having a center and edges, at least the center of said stepped-down area bearing against said ledge, through said insulating member, to exert pressure thereagainst.

4. The thermostatic device of claim 3 wherein the stepped-down area is formed at each end of said lid.

* * * * *